US007070293B2

(12) United States Patent
Seymour

(10) Patent No.: US 7,070,293 B2
(45) Date of Patent: Jul. 4, 2006

(54) LIGHTING ARRAY FOR WALL HANGINGS

(75) Inventor: Herb Seymour, Los Angeles, CA (US)

(73) Assignee: Herbert E. Seymour, Los Angeles, CA (US)

( * ) Notice: Subject to any disclaimer, the term of this patent is extended or adjusted under 35 U.S.C. 154(b) by 19 days.

(21) Appl. No.: 10/896,729

(22) Filed: Jul. 22, 2004

(65) Prior Publication Data

US 2006/0018112 A1 Jan. 26, 2006

(51) Int. Cl.
*F21S 8/00* (2006.01)

(52) U.S. Cl. ..... 362/147; 362/249; 362/250; 362/287

(58) Field of Classification Search ..... 362/147, 362/249, 250, 287
See application file for complete search history.

(56) References Cited

U.S. PATENT DOCUMENTS

| | | | | |
|---|---|---|---|---|
| 4,689,547 | A | 8/1987 | Rowen et al. | 323/239 |
| 4,716,344 | A | 12/1987 | Newell et al. | 315/312 |
| 4,727,296 | A | 2/1988 | Zaharchuk et al. | 315/295 |
| 4,745,351 | A | 5/1988 | Rowen et al. | 323/239 |
| 4,792,731 | A | 12/1988 | Pearlman et al. | 315/316 |
| 5,072,216 | A | 12/1991 | Grange | 340/825 |
| 5,491,463 | A | 2/1996 | Sargeant et al. | 340/310 |
| 5,526,245 | A | 6/1996 | Davis et al. | 362/233 |
| 5,903,226 | A | 5/1999 | Suman et al. | 340/825 |
| 6,170,967 | B1 * | 1/2001 | Usher et al. | 362/394 |
| 6,175,201 | B1 | 1/2001 | Sid | 315/312 |
| 6,331,813 | B1 | 12/2001 | Belliveau | 340/310.01 |
| 6,369,524 | B1 | 4/2002 | Sid | 315/292 |

* cited by examiner

*Primary Examiner*—Ali Alavi
*Assistant Examiner*—Meghan K. Dunwiddie
(74) *Attorney, Agent, or Firm*—Wm. Bruce Day

(57) ABSTRACT

A lighting system and exemplary array is particularly adapted for use with large wall-mounted objects, such as paintings, sculptures and other art objects. The lighting system provides a substantially uniform amount of illumination over the entire length and breadth of the art object. A lighting array is mounted directly above the art object and spaced outwardly from the plane of the object by several inches or more. The array consists of a housing containing a plurality of lighting elements. Each lighting element is arrayed linearly so that, with appropriate reflectors, lenses, attenuators, and/or diffusers, each lights a portion of the art object. The desired effect is that all areas of the art object are equally illuminated. Alternately, the lighting elements can be selected for intensity such that the array may have elements of different intensity directed at the different areas of the art object. In a second alternative, a pulse width modulated dimmer device allows adjusting the brightness of any picture light without changing the color temperature of that light. This allows the user to set the brightness of a picture light without changing the color temperature from a pre-set color temperature.

9 Claims, 2 Drawing Sheets

LIGHTING ARRAY FOR WALL HANGINGS

FIELD OF THE INVENTION

This invention relates to lighting systems for illuminating displayed art objects or other objects of note, in distinction to general purpose room or area lighting.

BACKGROUND OF THE INVENTION

Lighting systems for illuminating display objects, such as art objects, are frequently deficient, particularly for large objects like paintings. Small paintings or other display objects can be easily illuminated by strategically placed single lamps, but a problem is usually readily apparent when dealing with large, flat artwork. Typically illuminated by a single row of lamps, which may be mounted together in a housing, wall mounted over the painting, the lamps frequently illuminate the top third of the painting and leave the remainder of the painting dark and inadequately lighted. As a result, some galleries or private collectors increase the intensity of the lights, but then the painting can become over-illuminated in the spot lighted area, colors can fade and subtleties lost. Others attempt better illumination through use of sky lights in gallery rooms, but this is not always possible and lighting can still be uneven.

While it is always possible to mount multiple adjustable spot lights on the ceiling adjacent a large painting or other art object, multiple spot light mounts are not tidy appearing and wiring can be a problem. The optimum package for neat, compact and effective lighting would be a single array, or in the largest wall mounted paintings, two or more arrays, each with individual lamps targeting areas on the surface of the painting, and being capable of corresponding the intensity of the light arriving at the surface of the painting to the distance of the light source to the painting surface. This presents even illumination over the entire surface of the article and best presents the details of the painting.

Two dimensional art objects, more specifically paintings, best convey the intention of the artist when they are lighted uniformly, appropriately bright and with light with a "warmth" most suitable for that painting. "Picture Lights" sold for the purpose of lighting such art objects typically light with the brightness of the painting diminishing noticeably from the top to the bottom of the painting. Therefore, most paintings so lit do not meet the criterion of uniform illumination.

The "warmth" of the light is a description of the color spectrum present in the light, with "warm" light tending towards the red end of the spectrum and "cool" light tending toward the blue end of the spectrum. The quantitative description of this characteristic of light is called "Color Temperature" expressed in degrees Kelvin. The higher the color temperature, the cooler the light.

The ability to adjust the warmth of the light projected on a surface is well accepted in, say, stage lighting where "gel" filters are routinely placed in front of lights for the purpose of warming an otherwise "cool" light on a scene. Since this has never been applied to picture lighting, the use of filters to control the light on a painting is also one way of dealing with this need.

It has been common to control the intensity of the light on a painting with the use of dimmers. Such dimmers typically work by reducing the voltage to the light source. Unfortunately, the color temperature of incandescent lamps most commonly used in picture lighting will decrease as the source is dimmed, resulting in the light produced getting warmer as the light is dimmed. So, using the current technology, adjusting the brightness while keeping the preset, most desirable color temperature cannot be achieved.

The problem of uniformly lighting a painting is exacerbated the closer the light source is to the surface being lit. Thus, a painting lit with a typical picture light only inches above and inches out from the painting surface, will suffer greatly from lack of illumination uniformly. So, for example, a painting three feet tall, lit by such a light will be about one ninth as bright at the bottom as the top. The farther the light source is to a painting, relative to the paintings size, the less pronounced will be this effect.

Conventional picture lights often try to provide lighting uniformity by arraying a multiple number of lights along the width of the painting. Though this does not solve the reduction in lighting the height, it does ameliorate, to some extent, lighting uniformity along the width.

Many lighting manufacturers array a number of light sources in an elongated housing along the width of the painting in an effort to light the width of the painting which improves the lighting uniformity along the width. This approach is utilized by, but is not a subject of, the present invention.

Lighting manufacturers of products, predominantly for airfield lighting, have developed technology to control the distribution of light energy from a single light source that approximates a point source. This technology relies upon high power light emitting diodes. Such an application includes landing lights the brightness of which appears relatively constant as the plane nears landing and continuously subtends smaller angles. This technology could be successfully employed to solve the instant problem, but as such is currently too expensive to be commercially viable to this market. These methods rely upon the sculpturing of a single reflector assembly so as to redistribute the energy emitted by the light source in the desired pattern.

SUMMARY OF THE INVENTION

The present invention presents a lighting display or array particularly adapted for evenly illuminating the entire, or substantially entire, surface of a large display object, such as a wall hung painting. The array consists of a housing containing a plurality of lighting elements, arrayed linearly. The elements project light of unequal illumination depending upon the distance from the array to all areas on the surface of the article that need to be illuminated. Varying illumination can be caused by various means including lamps of selected intensity or attenuating devices placed in front of the lamp.

The instant invention provides a multiplicity of light sources and reflector assemblies or alternatively a graduated light attenuator such that the amount of light reaching the painting is attenuated inversely to the distance between the light source and the surface of the painting.

Various Embodiments as Disclosed:

1. A multiplicity of light sources arrayed linearly along the width of a painting. Each source has a reflector and/or lens assembly optimized to light a specific area of the painting and to provide sufficient light intensity for each specific area to approximately equal the light intensity of the adjacent area illuminated by another source from the same array.
2. A multiplicity of light sources arrayed linearly along the width of a painting each of which has a graduated density light attenuator such that the light reaching those portions of the painting closest to the light source are equally illuminated with those furthest from the light source.

3. A combination of 1 and 2 above.
4. The above in which provision is made for removable filters to allow customization of the color temperature to be most suitable for the specific painting.
5. In a separate embodiment, a pulse width modulated dimmer device which allows adjusting the brightness of any picture light without changing the color temperature of that light. This allows the user to set the brightness of a picture light without changing the color temperature from the preset color temperature.

OBJECTS OF THE INVENTION

The objects of the present invention are:

To provide a lighting array capable of evenly lighting the entire surface of an object;

To provide such a lighting array which is compact and orderly in appearance;

To provide such a lighting array which is substantially inconspicious when mounted;

To provide such a lighting array in which lighting elements can be easily removed and replaced; and To provide such a lighting array which is well-suited for the intended purpose.

DESCRIPTION OF THE PREFERRED AND ALTERNATE EMBODIMENT

Figure 1:
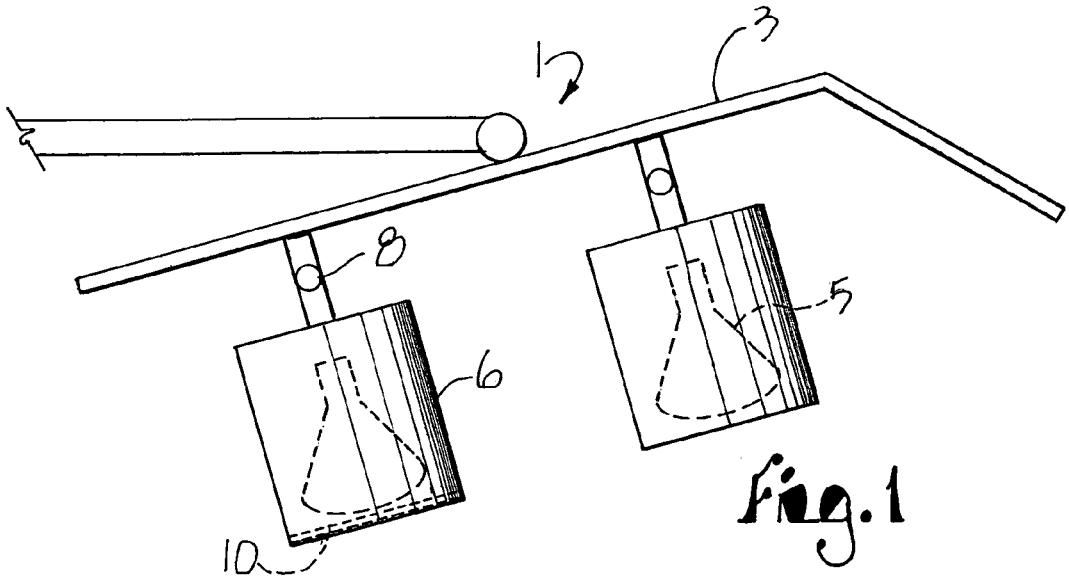
FIG. 1 is a diagrammatic view of a two row light assembly embodying the present invention.

Exemplary embodiments of the present invention are disclosed in the drawing figures. The reference 1, FIG. 1, generally designates a lighting system for art objects which is intended to evenly illuminate all of the surfaces of a large scale object in which the surfaces are at varying distance from the light source. In the example of the lighting system 1 shown in FIG. 1, there are two rows of lights, such as of five lamps each, and in the example shown in FIG. 2, there are three rows of five lamps each. Providing uniform illumination of works of art provides significant difficulties because the various surfaces of the art object are different distances from the light source. Often, the art objects are large, so that the varying surfaces of the art object are at varying distances from the light source. As used herein, the term art object is often a painting or other type of substantially planar of sculpture which is mounted or hung on a wall, although the lighting system of the present invention may be equally used with sculptures, either free-standing or pedestal mounted. Lighting systems are usually wall or ceiling mounted, as may be used in museums, commercial and home galleries. The lighting must be unobtrusive so that the view of gallery goer is focused on the art object rather than the lighting system. Generally, the lighting system is ceiling mounted in close proximity to the art object, but may be wall mounted from an arm mounted to the wall and extending outwardly.

The concept of the lighting system 1 envisions a light mounted directly above the painting and spaced out from the plane of the painting by several inches or more. The light consists of a housing or housings carrying lighting elements. The light sources within the housing are arrayed linearly so that, appropriate reflectors, lenses, and/or diffusers, would light the width of the painting. In that respect, the lighting system resembles conventional, presently available "picture lights."

The lighting of the width of the painting is not the inventive aspect of the present invention. The lighting of the painting uniformly for its full height, poses the problems for which this invention is intended to resolve. The difficulty is to regulate the amount of light reaching the surface of a painting so that the viewer of that painting will perceive the painting to be uniformly lit throughout its surface. Because the amount of light on a surface declines as the square of the distance between that surface and the light source, a typical picture light will light the part of the painting closest to the light far brighter than the part of the painting farthest from the light.

Figure 2:
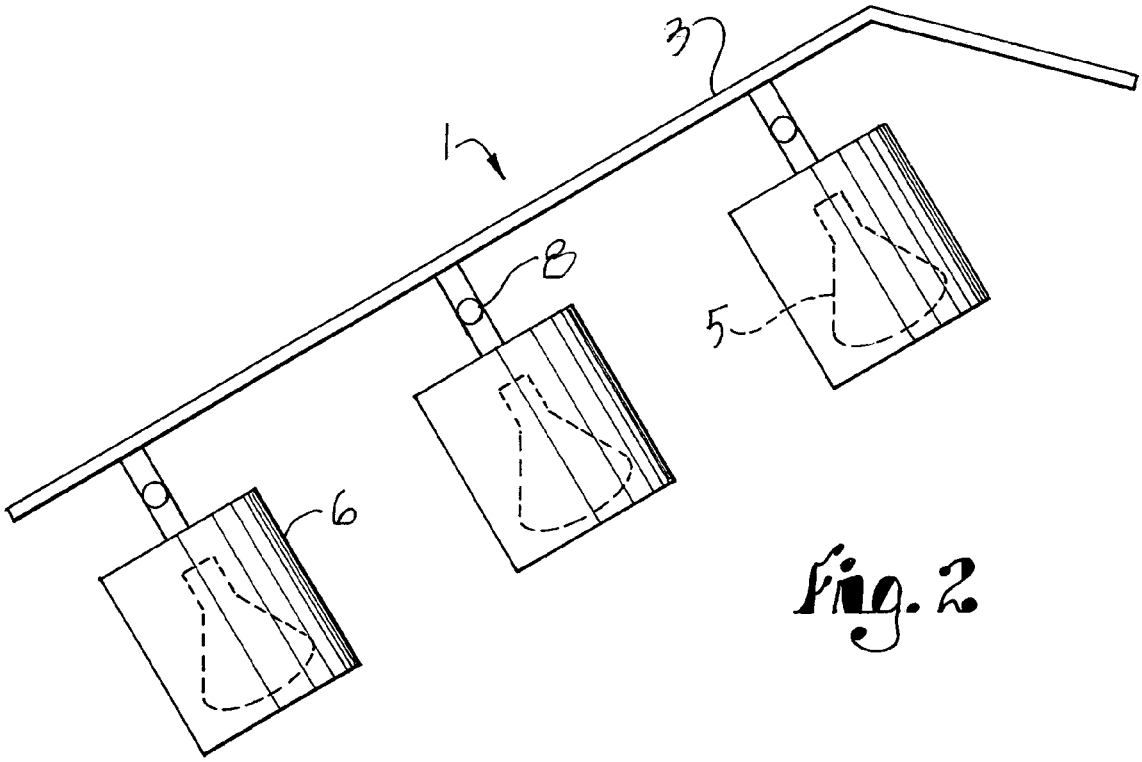
FIG. 2 is a diagrammatic view of a three row light assembly.
Figure 3:
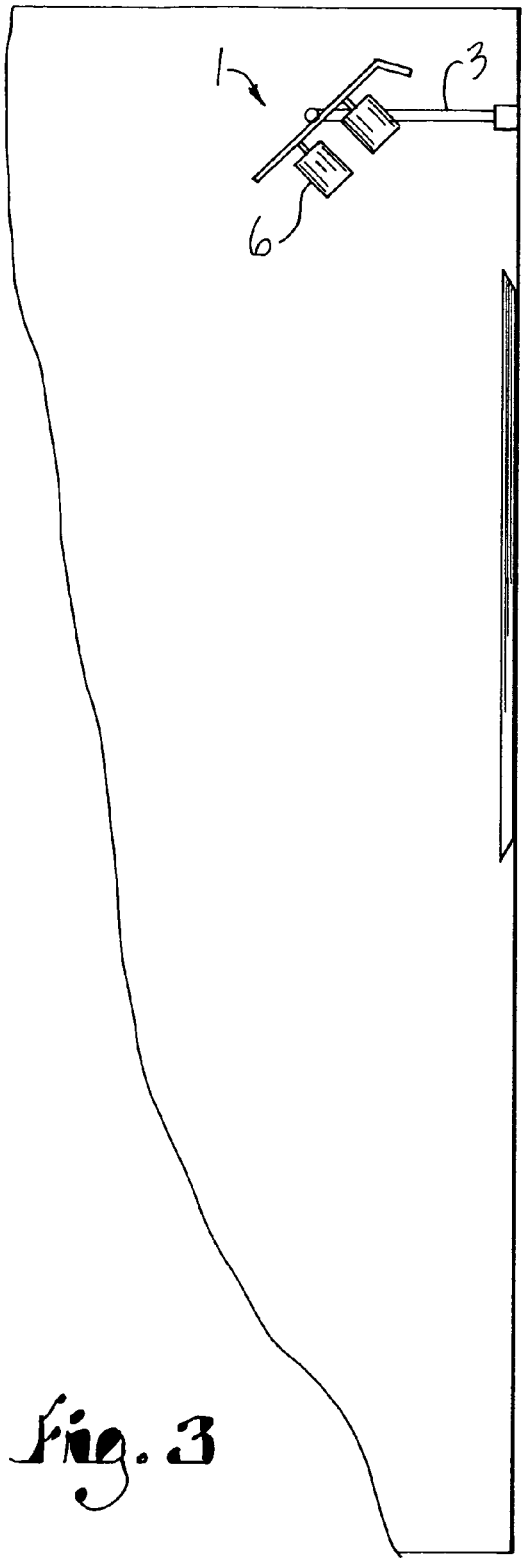
FIG. 3 is a diagrammatic view of a two row light assembly shown mounted on a ceiling and illuminating a wall mounted painting.
Figure 4:
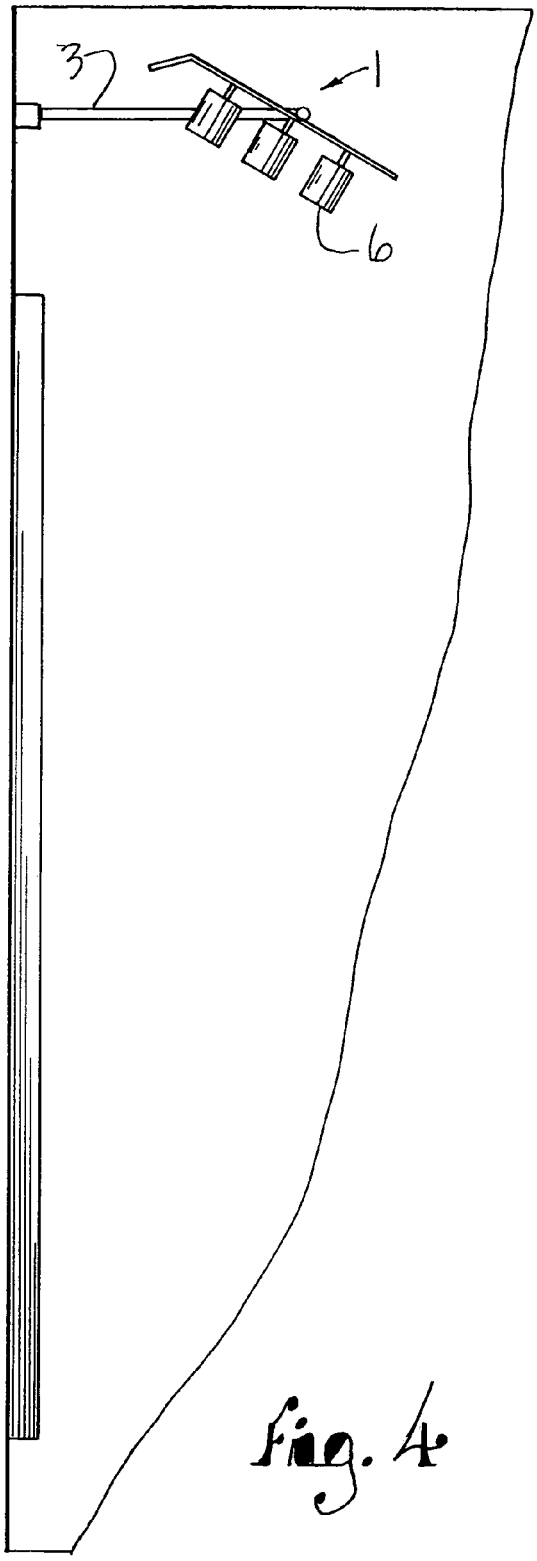
FIG. 4 is a diagrammatic view of a three row light assembly shown mounted on a ceiling and illuminating a wall mounted painting.

As shown in the drawings, a mounting bracket 3 is provided for a wall mount, although it can also be ceiling mounted. The mounting bracket 3 carries one or more rows of lamps 5 such as the two rows of lamps shown in FIG. 1 and the three rows of lamps 5 shown in FIG. 2. Each of the lamps is, in the illustrated example, enclosed within a cannister 6 which is preferably adjustably mounted to the mounting bracket 3 by a pivot mount 8. With just the arrangement as shown in FIGS. 1 and 2 without adjustment of the light output of each source, or controlling the amount of light from the source reaching the target, such as a painting, it will be seen that the surface of the painting in its entirety will not be uniformly illuminated. Although the lamps 5 may be adjusted via the pivot mounts 8 to direct their light on certain parts of the painting, some parts of the painting will remain more illuminated than other parts, such as the surfaces of the painting closest to the light source.

One method and a first embodiment of this invention uses a graduated optical attenuator inserted in the illumination's circuit, that is, between the light source lamp 5 and the target, such as painting. The attenuation of the light is inversely proportional to the distance between the source and the point where each ray reaches the target. An exemplary optical attenuator is identified as 10 in FIG. 1. The optical attenuator may take the form of a simple piece of glass with a graduated benday screen. Such a screen is created by an array of small dots on a transparent medium such as glass. The dots are positioned at a top so that each overlaps the next, and increasing spacing the progression from top to bottom, creating a gradient of 100% to 0% at the bottom. Alternatively, the dots could be reflective, and the light reaching the blocked part of the screen will be reflected by the light's reflector and ultimately will be re-directed to the lower part of the displayed painting. An alternative optical attenuator may also be a fixed light source with a programmed liquid crystal display (LCD) interposed in the light beam. Yet further alternatively, a reflective device, such as a DSP (Digital Signal Processing) chip may be interposed in the light beam. A DSP chip may be one in which the reflectivity can be controlled to yield variable brightness necessary for the large surface even illumination.

For example, a range of LED lights are available and different output LED's may be used in the lighting system 1.

Fluorescent, incandescent and halogen cycle lamps may be individually selected so as the higher output light lamp is directed toward the portion of the surface of the painting which is furthest away from the source and the lower output lamps directed to closer in areas of the painting.

Satisfactory results have been obtained respectively for 24×24 inch paintings and for 24×48 inch paintings. In the first, the 24×24, a two array design of five lighting elements each was used and in the second, the 24×48 inch painting, a three array of five elements was each used, corresponding to FIG. 1 and FIG. 2. Test results are set forth below.

2×5×24 Results 2 array, 5 element design for 24×24 inch painting

| | | |
|---|---|---|
| Array 1 | Lens Divergence FWHM | 45 deg. |
| | Number of Sources | 5 |
| | Y position in housing | 0.65 in. above center |
| | Angle in housing | 1 deg. down |
| | Source X positions | 0. +/−5, +/−10 inches |
| | Percent of rated power | 19% |
| Array 2 | Lens Divergence FWHM | 30 deg. |
| | Number of Sources | 5 |
| | Y position in housing | 0.65 in. below center |
| | Angle in housing | 27 deg. down |
| | Source X positions | 0. +/−5, +/−10 inches |
| | Percent of rated power | 100% |

3×5×48 Results 3 array, 5 element design for 24×48 inch painting

| | | |
|---|---|---|
| Array 1 | Lens Divergence FWHM | 45 deg. |
| | Number of Sources | 5 |
| | Y position in housing | 1.3 in. above center |
| | Angle in housing | 1 deg. down |
| | Source X positions | 0. +/−5, +/−10 inches |
| | Percent of rated power | 27% |
| Array 2 | Lens Divergence FWHM | 30 deg. |
| | Number of Sources | 5 |
| | Y position in housing | 0 in. below center |
| | Angle in housing | 24 deg. down |
| | Source X positions | 0. +/−5, +/−10 inches |
| | Percent of rated power | 100% |
| Array 3 | Lens Divergence FWHM | 10 deg. |
| | Number of Sources | 5 |
| | Y position in housing | −1.5 in. below center |
| | Angle in housing | 22 deg. down |
| | Source X positions | 0. +/−5, +/−10 inches |
| | Percent of rated power | 72% |

Although other embodiments of the invention may be conceived within the scope of the invention, the scope of the invention is not to be limited except as set forth in the following claims:

What is claimed and desired to be secured by Letters Patent is:

1. A lighting array for uniformly illuminating large objects comprising:

a) a plurality of illumination sources mounted in an array, said array being positionable so as to illuminate a large object with said array being an unequal distance from all areas of the surface of said object; and b) means for setting an illumination intensity of each of the illumination sources in said array so as to adjust the array so that each of the surface areas receives a substantially equal distribution of illumination.

2. The lighting array set forth claim 1 wherein:

a) the illumination sources in the array emit light of equal intensity, and the array includes b) optical attenuators positioned between respective light sources and the object.

3. The lighting array set forth in claim 2 wherein the optical attenuators are lenses with a graduated screen in which the attenuators vary inversely by the square of the distance between the source and a selected surface area of the object.

4. The lighting array set forth in claim 2 wherein the optical attenuators are reflective devices in which reflectivity can be controlled to yield variable brightness for uniform illumination.

5. The lighting array set forth in claim 1 wherein said illumination sources are adjustable in light output, and each of said sources is aimed at a specific area of the object, the adjustment compensating for the attenuation caused by the distance between the illumination source and the specific area of the object.

6. The lighting array set forth in claim 1 wherein said illumination sources are selected from a group of sources of selected levels of intensity, with selected sources mounted in the array to compensate for the attenuation caused by the distance between the illumination source and the specific area of the object.

7. The lighting array set forth in claim 2 wherein said illumination sources are the same in intensity, and selected ones are attenuated by fixed optical attenuators in front of the selected sources to reduce the intensity inversely proportional to the distance necessary to reach all surface areas of the object.

8. The lighting array set forth in claim 1 wherein the light source is one of the following: halogen bulbs, light emitting diodes, incandescent lamps, and fluorescent lights, and including integral reflector assemblies used therewith.

9. A lighting array for uniformly illuminating large objects comprising:

a) a plurality of illumination sources mounted in an array, the illumination sources being positionable within said array so as to illuminate a large object with the array being an unequal distance from all areas of the surface of said object; and b) said illumination sources providing a differing amount of illumination selected so that the sources as a whole illuminate the object uniformly regardless of the distance of the illumination source to the object.

* * * * *